US005361019A

United States Patent [19]

Angott et al.

[11] Patent Number: 5,361,019

[45] Date of Patent: Nov. 1, 1994

[54] LAMP DIMMING DEVICE

[75] Inventors: Paul G. Angott, Troy; Thomas G. Xydis, Ann Arbor, both of Mich.

[73] Assignee: Dimango Products Corporation, Brighton, Mich.

[21] Appl. No.: 24,338

[22] Filed: Mar. 1, 1993

[51] Int. Cl.[5] ..... H05B 41/38

[52] U.S. Cl. ..... 315/324; 315/313; 315/362

[58] Field of Search ..... 315/362, 324, 313, 250

[56] References Cited

U.S. PATENT DOCUMENTS

| | | | |
|---|---|---|---|
| 502,471 | 8/1893 | Scribner . | |
| 621,739 | 3/1899 | Baumann . | |
| 1,326,301 | 12/1919 | Staehle . | |
| 2,012,419 | 8/1935 | Daniels . | |
| 2,594,622 | 4/1952 | Douglass . | |
| 2,866,133 | 12/1958 | Strange et al. . | |
| 3,078,389 | 2/1963 | Corry . | |
| 3,240,992 | 3/1966 | Hallay . | |
| 3,263,119 | 7/1966 | Scholl . | |
| 3,534,224 | 10/1970 | Skirpan et al. . | |
| 4,488,092 | 12/1984 | Chikuma | 315/313 |
| 4,518,896 | 5/1985 | Miles, Jr. . | |
| 4,766,353 | 8/1988 | Burgess | 315/362 |
| 4,772,825 | 9/1988 | Tabor et al. . | |
| 4,802,073 | 1/1989 | Plumly | 315/362 |
| 4,896,079 | 1/1990 | Tabor | 315/313 |
| 4,899,089 | 2/1990 | Hayes . | |
| 5,194,781 | 3/1993 | Konopka | 315/362 |

*Primary Examiner*—Edward K. Look
*Assistant Examiner*—James A. Larson
*Attorney, Agent, or Firm*—Reising, Ethington Barnard, Perry & Milton

[57] ABSTRACT

An illumination level control device (10) is disclosed which sequentially reduces the illumination level of a multi-bulb lamp (12). The illumination level control device (10) incorporates two D flip-flops (38,40) configured in a master-slave relationship wherein the two D flip-flops (38,40) change their respective states when the clock (60) sends a positive-edge of the clock signal thereto. A portion (58) of the device (10) sets the two D flip-flops (38,40) when the wall switch (22) is off for more than a predetermined time. In the case of a three bulb (14,16,18) lamp (12), a zero state preventor (56) prevents all of the bulbs (14,16,18) from being turned off when the wall switch (22) is in the ON position. The zero state preventor (56) effectively eliminates the state wherein the outputs of both of the two D flip-flops (38,40) are low.

12 Claims, 4 Drawing Sheets

16
14
18
12
34
10
34
22
20
36
54
38
50
46
52
40
48
44
42
Q
Q̄
R
CLK
S
D
Q7
Q8
R17
R18
R19
R20
D1
D2
D7
D11
C1
C2
C5
C6
C7
R5
R8
R9
R10
R11
Q4
58
VDD
VSS

LAMP DIMMING DEVICE

BACKGROUND OF THE INVENTION

1. Technical Field

The subject invention relates to switches for lighting systems having a plurality of bulbs. More particularly, the subject invention relates to an electronic switch located in the power supply circuit of a lamp for reducing the level of illumination of a fluorescent lamp.

2. Description of Related Art

As the cost of energy continues to climb alongside increased awareness of the need for energy conservation, more and more areas of energy consumption are being viewed with an eye toward energy consumption. Fluorescent illumination has been targeted as an area to reduce energy consumption by reducing the amount of illumination emanating from a fluorescent lamp. However, such systems are costly, especially when retro-fitting, and provide minimal energy savings.

The most recent attempt at a circuit which could regulate the illumination level of a fluorescent lamp is U.S. Pat. No. 4,896,079 to Tabor, issued on Jan. 23, 1990. This patent discloses a switch, connected between a toggle power switch and the fluorescent lamp, that switches one set of fluorescent bulbs, either one bulb or two, on and off with each successive toggle of their toggle power switch. Also included in the design is a reset feature which will reset the number of bulbs turned on if the toggle power switch is in the off position for a time greater than a predetermined time. This device falls short of what is needed in the marketplace because it only offers two different levels of illumination. In addition, the device does not have the capability of combining different combinations of bulbs to provide a plurality of illumination levels greater than two.

SUMMARY OF THE INVENTION AND ADVANTAGES

An illumination level control device controls the level of illumination in a lamp having at least three bulbs. The lamp is connected to an electrical power line which is controlled by a power toggle switch. The illumination level control device comprises switching means for switching at least two bulbs off and on. Connecting means connects the switching means to at least two of the bulbs and to the electrical power line supplying electrical power to the lamp. The illumination level control device is characterized by controlling means responsive to successive toggling of the power toggle switch across the electrical power line for controlling the switching means such that the controlling means operates the switching means to sequentially change the number of bulbs being illuminated at any one time through at least three different levels of illumination.

The subject invention provides the advantage of switching combinations of bulbs off and on to produce a plurality of illumination levels greater than two without adding considerable cost or energy consumption. Additionally, noise or hum, which is a byproduct of most dimmer switches, is not present.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figures 1, 2A:
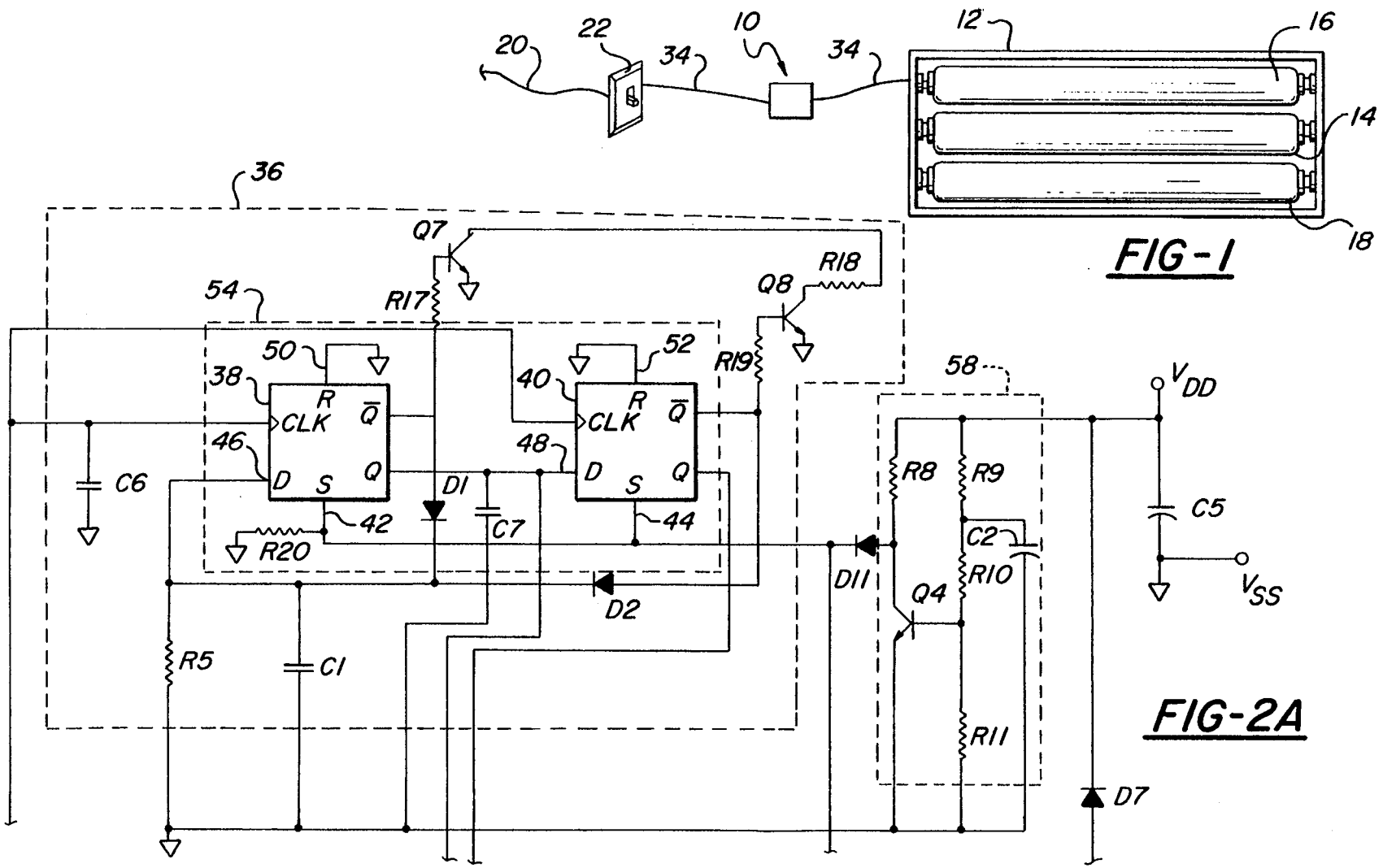
FIG. 1 is a bottom view of a fluorescent lamp with three fluorescent bulbs connected electrically to the subject invention which is connected to a power toggle switch, shown in perspective.
FIG. 2A is the first half of a schematic drawing of the embodiment of the subject invention used in conjunction with a three bulb fluorescent lamp.

The subject invention, generally shown at 10 in the Figures, is an illumination level control device. The illumination level control device 10 controls the level of illumination in a lamp 12 having at least three bulbs 14,16,18 connected to an electrical power line 20 which is controlled by a toggle power switch 22. The illumination level control device 10 may be used with lamps comprising three or more bulbs 14',16',18',19 (referring to FIG. 3) wherein the bulbs 14',16',18',19 may be any type of bulb, i.e., incandescent, fluorescent, phosphorescent, because the subject invention 10 will not include electronics specific to any one type of illumination format.

Figure 2B:
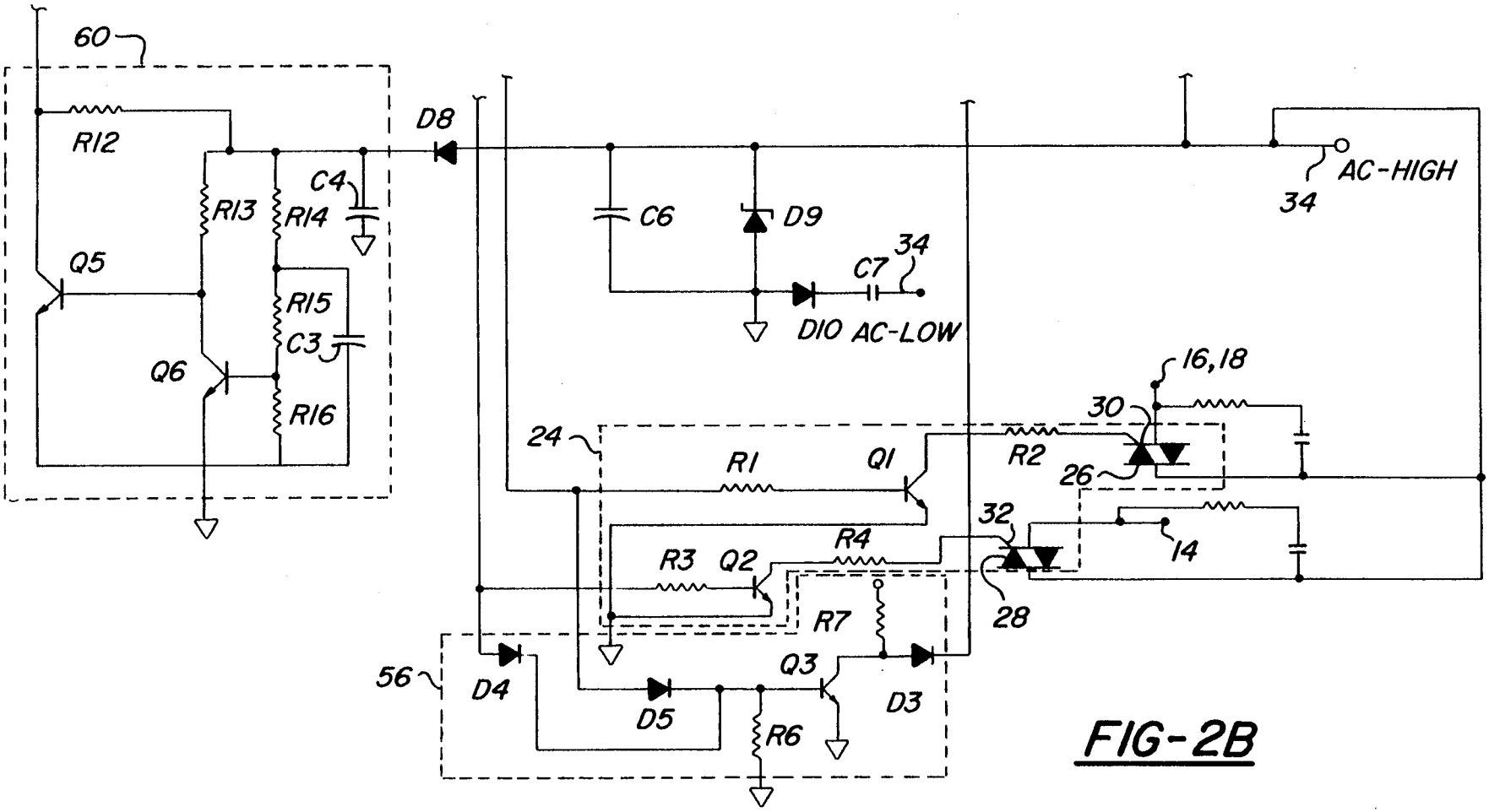
FIG. 2B is the second half of a schematic drawing of the embodiment of the subject invention used in conjunction with the three bulb fluorescent lamp.
Figure 3:
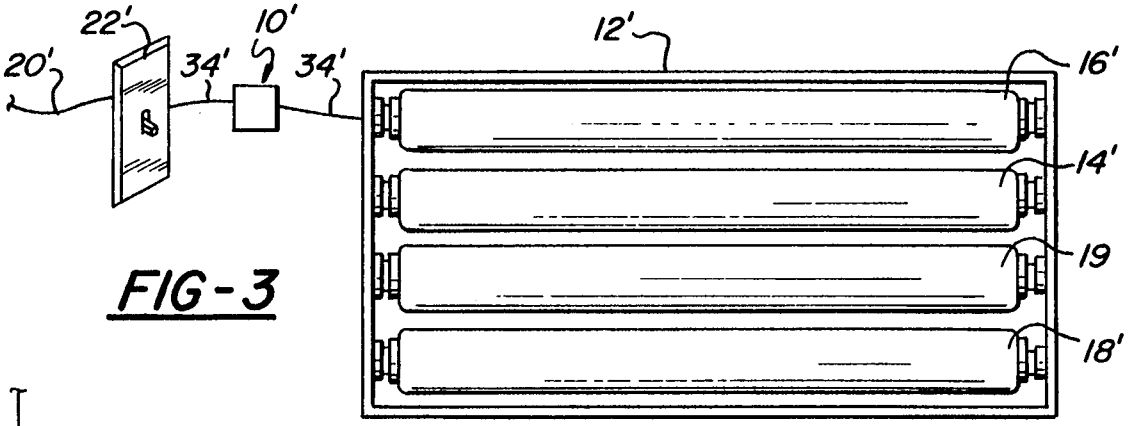
FIG. 3 is the bottom view of a fluorescent lamp with four fluorescent bulbs electrically connected to the preferred embodiment of the subject invention, which is electrically connected to a power toggle switch, shown in perspective.

The illumination level control device 10 will be described in detail using a three bulb lamp configuration, as may best be seen in FIGS. 2A and 2B. Like primed numerals shown in FIGS. 4A and 4B refer to like or identical components used for a four bulb lamp, as shown in FIG. 3. Only the differences in the embodiments between the three bulb lamp and the four bulb lamp will be described when discussing the four bulb lamp embodiment.

Returning our attention to FIGS. 1, 2A and 2B, the three bulb embodiment 10 includes switching means 24 for switching at least two bulbs off and on. The switching means comprising two triacs 26,28 four resistors R1,R2,R3,R4 and two transistors Q1,Q2. The two transistors Q1,Q2 are connected to the two triacs 26,28 through the resistors R2 and R4, respectively. The transistors Q1,Q2 are connected to the gates 30,32 of the triacs 26,28 respectively. The triac 28 is connected to one bulb whereas the triac 26 is connected to two bulbs.

With regard to switching the bulbs 14,16,18 on and off, when the power toggle switch 22, a typical wall switch, is turned on, all three bulbs 14,16,18 will turn on as if the wall switch 22 were connected to the lamp 12 normally. In other words, the illumination level control device 10 is hidden to the user during the first step. When the light switch is turned off and back on again, the triac 28 will turn off the power to the first or center bulb 14. When the light switch 22 is turned off and on again, the first or center bulb 14 will turn back on whereas the second and third outside bulbs 16,18 are turned off. This configuration of alternating between turning the first center bulb 14 off and the two outside bulbs 16,18 off is used to maintain symmetry of the illumination of the lamp 12.

The illumination level control device 10 further includes connecting means 34 for connecting the switching means 24 to at least two of the bulbs 14,16,18 and to an electrical power line 20 which supplies electrical power to the lamp 12. In the three bulb embodiment, the subject invention is connected to all three bulbs 14,16,18. The connecting means 34 may be any type of connector, be it wires, as is shown in FIG. 1, or ports to receive extensions of wires from the lamp 12 and the regular electrical wiring found in the building. In FIG. 2B, AC high and AC low represent the connecting means 34.

The subject invention 10 is characterized by controlling means 36 responsive to successive toggling of the wall switch 22 across the electric power line 20 for controlling the switching means 24 such that the controlling means 36 operates the switching means 24 to sequentially change the number of bulbs 14,16,18 being illuminated at any one given time through at least three different levels of illumination. Said another way, each time the wall switch 22 is turned off and back on again, the number of bulbs 14,16,18 which are illuminating is changed by one, i.e., either one more is on or one more is off, depending on the embodiment used.

In the preferred embodiment, the controlling means 36 sequentially reduces the levels of illumination by one bulb with each successive toggle of the wall switch 22. However, it should be noted that sequentially increasing the levels of illumination through at least three levels of illumination is within the scope of the subject invention 10.

The controlling means 36 includes two dual type D positive-edge-triggered flip-flops 38,40 ("D flip-flops"). Power is received by the set port 42,44 of each of the D flip-flops 38,40. The set ports 42,44 are tied to ground through a resistor R20. The inverted output of the second D flip-flop 40 is tied to the D port 46 of the first D flip-flop 38. The inverted output of the first D flip-flop 38 is tied through a diode D1, capacitor C1 and resistor R5 to ground. The output of the first D flip-flop 38 is tied to the D port 48 of the second D flip-flop 40. In addition, the output of the first D flip-flop 38 is tied to ground through capacitor C7. The reset terminals 50,52 of the two D flip-flops 38,40 are connected to ground. The inverted output of the second D flip-flop 40 is also connected through diode D2, resistor R5 and capacitor C1 to ground.

The outputs of each of the first 38 and second 40 D flip-flops are also tied to the resistors R1,R3 of the switching means 24, which are connected to the bases of the two transistors Q1,Q2, respectively. Therefore, the outputs of the two D flip-flops 38,40 directly control the ability of the two transistors Q1,Q2 to conduct current therethrough. The output, Q, of the first D flip-flop 38 is also tied to ground through a capacitor C7.

The controlling means 36 includes state generating means 54 for generating a plurality of combinations of states in which the switching means 24 exist. The state generating means 54 comprises the two D flip-flops 38,40 connected in a master-slave configuration. The states created by the state generating means 54 determine when the transistors Q1,Q2 of the switching means 24 are turned on and off. For example, when the wall switch 22 is turned on for the first time, both outputs of the D flip-flops 38,40 are high which allows the transistors Q1,Q2 to conduct which in turn allows the triacs 26,28 to conduct. When both triacs 26,28 are allowed to conduct, all three bulbs 14,16,18 are illuminating. When, however, the wall switch 22 is turned off and on rapidly, the output of the first D flip-flop 38 goes low which prevents the transistor Q2 and second triac 28 from conducting, thus turning off the first middle bulb 14 allowing the two outer bulbs 16,18 to remain in their illuminating state. Again, when the wall switch 22 is turned off and on rapidly, the output of the first D flip-flop 38 goes high while the output of the second D flip-flop 40 goes low allowing the first lamp 14 to illuminate while the two outer light bulbs 16,18 are turned off and, therefore, are non-illuminating. And, finally, when the wall switch 22 is turned off and on rapidly for a third time, all three bulbs 14,16,18 are turned on because the outputs of the two D flip-flops 38,40 are high.

The two D flip-flops 38,40 are configured such that they react to positive edges of the signal which is sent to the clock port of the first D flip-flop 38. Therefore, the state generating means 54 only reacts to the positive edge of a signal which, in this environment, is the turning on of the wall switch 22.

The inverted output, $\overline{Q}$, of the second D flip-flop 40 is tied directly, through diode D2, to the D port of the first D flip-flop 38. In addition, the inverted outputs of each of the two D flip-flops 38,40 are tied to each other through two transistors Q7,Q8 through three resistors R17,R18,R19.

As one skilled in the art might observe, a fourth state, wherein both outputs of the D flip-flops 38,40 are low, is missing from the sequence or set of states capable of the state generating means 54 when configured as such. This fourth state, the zero state, is not necessary because the three light bulbs 14,16,18 will be in their non-illuminating states when the wall switch 22 is merely turned off. In fact, it would be very counterproductive for an operator to turn the wall switch 22 off and on a fourth time to sequence back to the first state with all the bulbs 14,16,18 in their illuminating state.

Therefore, zero state preventing means 56 is employed to prevent all the bulbs 14,16,18 from being toggled off at the same time while the wall switch 22 is in the on position. The zero state preventing means 56 includes diodes D3, D4 and D5, resistors R6 and R7, along with a third transistor Q3. The diodes D4,D5 are connected to the outputs of the two D flip-flops 38,40 wherein the output of the third diode D3 in the zero state preventing means 56 is tied to the set ports 42,44 of the D flip-flops 38,40. When neither output of the two D flip-flops 38,40 are conducting, the transistor Q3 is not able to conduct and, therefore, a set signal is sent to the two set ports 42,44 of the two D flip-flops 38,40.

Setting means 58 sets the state generating means 54 to turn all of the bulbs 14,16,18 on into their illuminating states when the wall switch 22 is turned on after the wall switch 22 has been turned off for a predetermined period of time. More specifically, the setting means 58, which is connected to both of the set ports 42,44 of the two D flip-flops 38,40, sets the two D flip-flops 38,40 to their first state (the state in which both outputs are high). The setting means 58 prevents an operator from coming into a room and turning on the wall switch 22 only to illuminate a portion of the number of bulbs 14,16,18 which are capable of being illuminated, thus preventing confusion to those operators not familiar with the capability of dimming the lamp 12 via the wall switch 22. The capacitor C2, along with resistors R8,R9,R10,R11 will be selected to create a time constant which will satisfactorily allow an operator to turn the wall switch 22 off and on to activate the illumination level control device 10 without automatically setting the D flip-flops 38,40. Once the power is turned off and the capacitor C2 has discharged, a transistor Q4 stops conducting which, in turn, sends a current through resistor R8 to set the set ports 42,44 to reset the D flip-flops 38,40. A diode D11 is connected between the setting means 58 and the set ports 42,44.

Clocking means 60 clocks the state generating means 54. The clocking means 60 is tied directly to the wall switch 22 and the output of the clocking means 60 is tied, through a capacitor C3, to each of the clocking ports of the two D flip-flops 38,40. Once the wall switch 22 is turned off and back on again, the clocking means 60 sends another positive edge of the signal to the D flip-flops 38,40 to enter the next state which will change the number of bulbs 14,16,18 which will be illuminated. More specifically, the clocking means 60 sends the pulse train used to clock the two D flip-flops 38,40. If, for example, the reset means 58 has reset the D flip-flops 38,40, the output of the clocking means 60 will put the two D flip-flops 38,40 in its first state which will illuminate all of the three bulbs 14,16,18.

The clocking means 60 includes resistors R12,R13,R14,R15,R16, capacitors C3 and C4 and transistors Q5 and Q6.

To prevent glitches in the subject invention 10 due to spiking in the power line 20, capacitor C6 is used to power the subject invention 10. Additionally, diodes D7 and D8 protect the reset means 58 and the clocking means 60, respectively, from any spiking which may occur. In addition, diodes D9 and D10 and capacitors C6 and C7 protect the switching means 24 from any spiking which may occur.

Figure 4B:
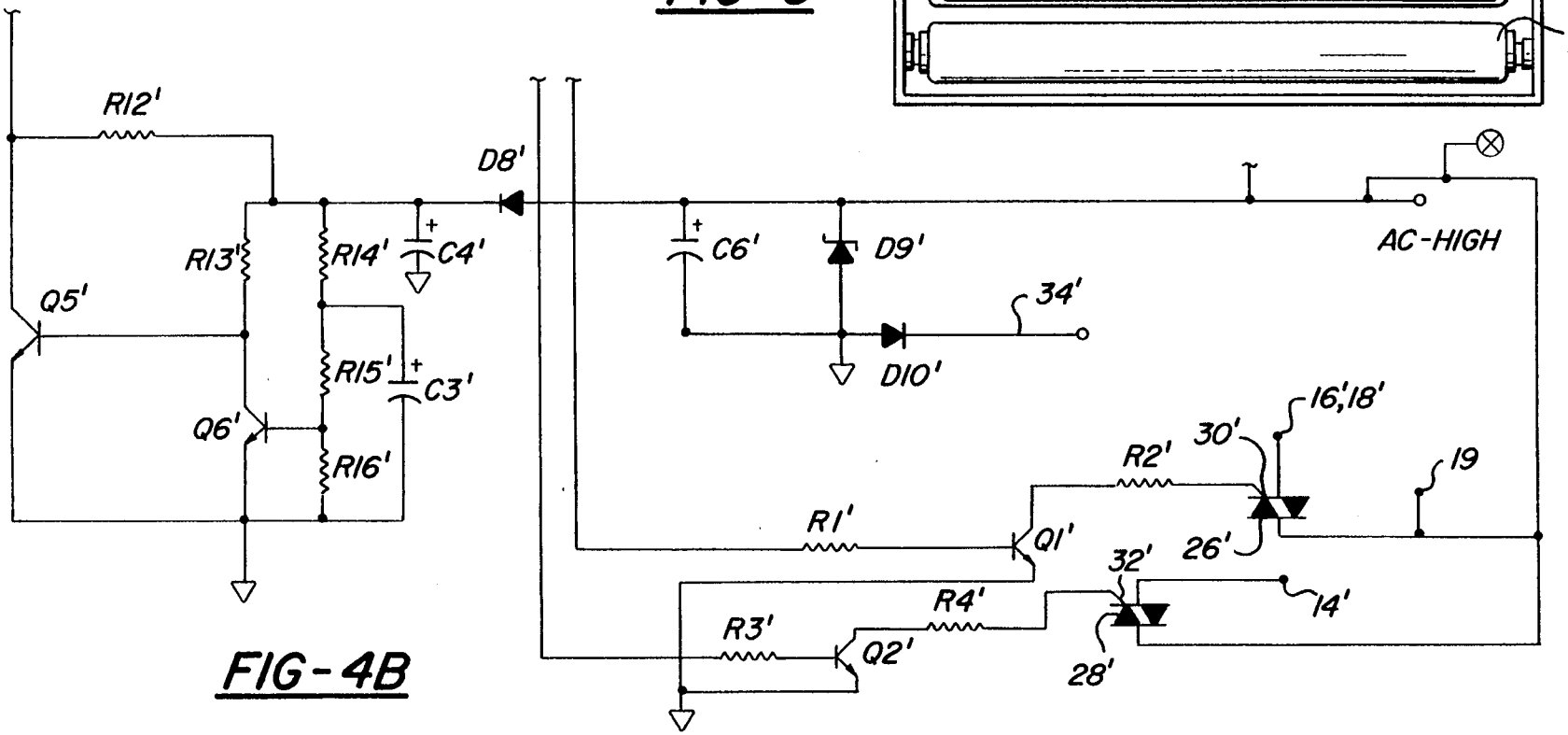
FIG. 4B is the second half of the schematic drawing of the embodiment of the subject invention used in conjunction with the four bulb fluorescent lamp.
Figure 4A:
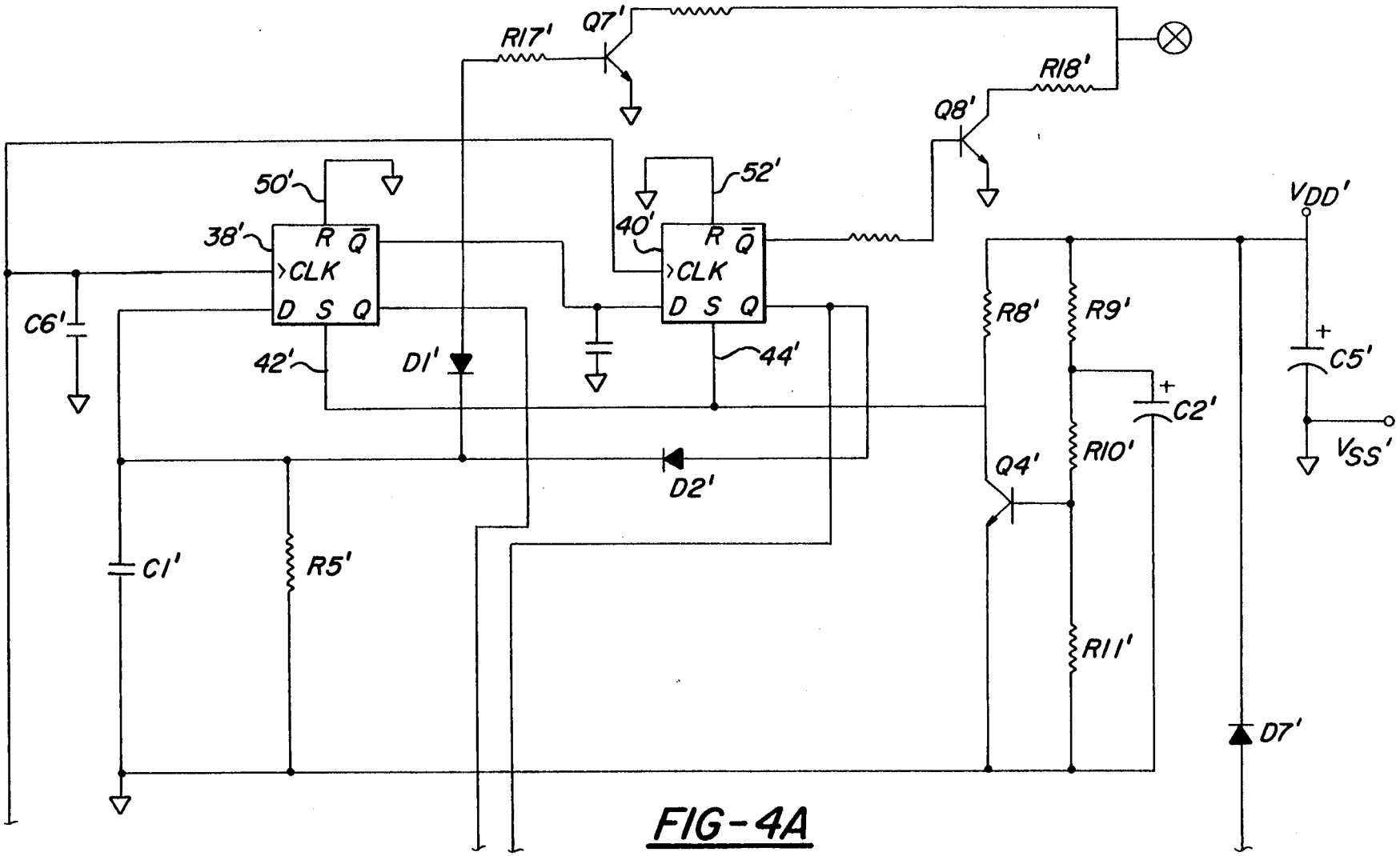
FIG. 4A is the first half of a schematic drawing of the embodiment of the subject invention used in conjunction with the four bulb fluorescent lamp.

Turning our attention to the four bulb embodiment, FIGS. 3 and 4A–B, it may be seen that the general design is substantially similar to the three bulb embodiment. A major difference between the two embodiments, however, is that one bulb 19 is connected directly to the wall switch 22, i.e., AC high. The bulb 19 will be located between two other bulbs and will be on whenever the wall switch 22 is turned on.

Again, only two triacs 26',28' are needed to switch between four different levels of illumination, i.e., between the illumination levels of four bulbs, three bulbs, two bulbs, and one bulb, wherein the outer two bulbs 16',18' are connected to triac 26' and the second interior bulb 14' is connected to triac 28'. The state sequence in which the two D flip-flops 38',40' will illuminate the bulbs 14',16',18',19 are i) all four bulbs illuminated at the same time; ii) the three bulbs 19,16',18' are turned on while the second interior bulb 14' is turned off; iii) the two outer bulbs 16',18' are turned off and the two interior bulbs 14',19 are turned on; iv) the two outer bulbs 16',18' and the second interior bulb 14' are all turned off while the first interior bulb 19 remains on.

Because the first interior bulb 19 is connected directly to the wall switch 22 allowing both switches 26',28' to be in the off position, a zero state prevention means 56 as designed for the three bulb embodiment is not necessary and, therefore, not present in the four bulb embodiment.

The method for sequentially dimming the lamp 12 having the plurality of bulbs 14,16,18 comprises the steps of: turning the wall switch 20 on; turning the wall switch 20 off and on within a predetermined time period to reduce the number of bulbs 14,16,18 being illuminated to a level of illumination corresponding to one of the plurality of bulb 14,16,18; and turning the wall switch 20 off and on within a predetermined time period a second time to again reduce the number of bulbs 14,16,18 being illuminated to the level of illumination corresponding to another of the bulbs 14,16,18. Each time the wall switch 20 is rapidly turned off and back on, one more of the bulbs 14,16,18 remains off after the wall switch 20 is turned to the ON position. This cycle will continue until only one bulb remains illuminating, after which a subsequent toggling of the wall switch 20 in both directions, i.e., off and back on again, will result in all of the bulbs 14,16,18 illuminating.

The method is further characterized by turning the wall switch 20 off for a time period greater than the predetermined time period to illuminate all of the plurality of bulbs 14,16,18 after the wall switch 20 is subsequently turned to the ON position. In other words, when the wall switch 20 is toggled twice, off and on, in a slow fashion, i.e., a time lapse of more than 5 seconds, the control means 36 will be reset resulting in all of the bulbs 14,16,18 illuminating.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

We claim:

1. An illumination level control device (10) for controlling the level of illumination in a lamp (12) having at least three bulbs (14,16,18) connected to an electrical power line (20) and controlled by a toggle power switch (22) having on and off positions, said illumination level control device (10) comprising:

switching means (24) for switching the bulbs (14,16,18) off and on;

connecting means (34) for connecting said switching means (24) to at least two of the bulbs (14,16,18) and to the electrical power line (20) supplying electrical power, said illumination level control device (10) characterized by controlling means (36) responsive to successive toggling between the on position and the off position of the toggle power switch (22) across the electrical power line (20) for controlling said switching means (24) such that said controlling means (36) operates said switching means (24) to sequentially change the number of the bulbs (14,16,18) being illuminated at any one time through at least three different levels of illuminations using symmetrical combinations of the bulbs (14,16,18) to maximize illumination symmetry of the lamp (12).

2. A device (10) as set forth in claim 1 further characterized by said controlling means (36) including state generating means (54) for generating a plurality of combinations of output states to be received by said switching means (24).

3. A device (10) as set forth in claim 2 further characterized by zero state preventing means (56) for preventing all of the bulbs (14,16,18) from being toggled off at the same time while the toggle power switch (22) is in an on position.

4. A device (10) as set forth in either claims 2 or 3 further characterized by reset means (58) for resetting said state generating means (54) to turn all of the bulbs (14,16,18) on when the toggle power switch (22) is turned on after the toggle power switch (22) has been in the off position for a predetermined time.

5. A device (10) as set forth in claim 4 further characterized by said switching means (24) including a plurality of switches (26,28).

6. A device (10) as set forth in claim 5 further characterized by each of said plurality of switches (26,28) electrically connected to at least one of the bulbs (14,16,18).

7. A device (10) as set forth in claim 6 further characterized by clocking means (60) for clocking said state generating means (36).

8. A device (10) as set forth in claim 7 further characterized by said state generating means including first (38) and second (40) D flip-flops each having an input and positive and negative outputs such that said positive output of said first flip-flop (38) is connected to the input of said second flip-flop (40) and said negative output of said second flip-flop (40) is connected to said input of said first flip-flop (38).

9. A device (10) as set forth in claim 8 further characterized by said positive output of said first flip-flop (38) being electrically connected to a first (26) of said plurality of switches (26,28).

10. A device (10) as set forth in claim 9 further characterized by said positive output of said second flip-flop (40) being electrically connected to a second (28) of said plurality of switches (26,28).

11. A method for sequentially dimming a lamp (12) having a plurality of bulbs (14,16,18) receiving power from an electrical line (20) controlled by a power toggle switch (22), the method comprising the steps of:

turning the power toggle switch (22) off and on within a predetermined time period to symmetrically reduce the number of bulbs (14,16,18) being illuminated; and turning the power toggle switch (22) off and on within a predetermined time period a second time to again symmetrically reduce the number of bulbs (14,16,18) being illuminated to reduce the level of illumination of the lamp (12).

12. A method as set forth in claim 11 further characterized by turning the power toggle switch (20) off for a time period greater than the predetermined time period to illuminate all of the plurality of bulbs (14,16,18) after the power toggle switch (20) is subsequently turned on.

* * * * *